United States Patent [19]

Bredehoeft et al.

[11] 4,179,054

[45] Dec. 18, 1979

[54] RACQUET CARRIER

[76] Inventors: Edwin L. Bredehoeft, 16761 Green St., #A, Huntington Beach, Calif. 92649; Robert E. Lee, 15 Ima Loa, Newport Beach, Calif. 92663

[21] Appl. No.: 914,793

[22] Filed: Jun. 12, 1978

[51] Int. Cl.[2] ..... B65D 71/00

[52] U.S. Cl. ..... 224/45 L; 150/52 G; 206/315 B; 273/74

[58] Field of Search ..... 206/315 R, 315 B; 150/52 G, 52 A; 273/74; 280/11.37 A, 11.37 K; 224/45 L, 45 P, 46 R, 45 S

[56] References Cited

U.S. PATENT DOCUMENTS

| | | | |
|---|---|---|---|
| 3,521,690 | 7/1970 | Davis | 150/52 A |
| 3,554,257 | 1/1971 | Glantz et al. | 150/52 A |
| 3,892,343 | 7/1975 | Warner | 280/11.37 K |
| 3,935,977 | 2/1976 | Bonnett | 280/11.37 K |
| 3,990,655 | 11/1976 | Covell | 224/45 S |
| 4,007,930 | 2/1977 | Straus | 206/315 B |

FOREIGN PATENT DOCUMENTS

| | | | |
|---|---|---|---|
| 1006481 | 3/1977 | Canada | 224/45 S |
| 1003806 | 3/1952 | France | 224/45 L |

*Primary Examiner*—Stephen P. Garbe
*Attorney, Agent, or Firm*—William C. Babcock

[57] ABSTRACT

A combined tennis racquet and ball carrier comprising a rectangular base structure provided with a spine member forming a handle on the dorsal surface thereof, the ventral surface forming a support. Hinged to the lateral edges of the ventral surface are two side panels each including a spring latching clip conformed to engage corresponding latching recesses in the handle structure. The interior cavity within the rectangular base is conformed to store tennis balls either collected in a can or loose. Similarly the opposing surfaces on the handle and the side panels include a layer of elastic foam for compressing the lateral faces of two tennis racquets therebetween.

5 Claims, 6 Drawing Figures

RACQUET CARRIER

BACKGROUND OF THE INVENTION

1. Field of the Invention

The present invention relates to athletic equipment, and more particularly to carriers adapted to transport tennis racquets and tennis balls in a single assembly.

2. Description of the Prior Art

Carrying aides are most frequently found in conjunction with transporting large articles like skiis. Various athletic endeavors often entail items of equipment which are transported to the athletic field and as the athlete becomes more profficient the selection of equipment becomes more refined with the attendant increase in carrying complexity. Concurrent with skiing the sport of tennis has had a recent increase in popularity with the attendant multiplication of various racquet structures that are now in use. Thus a tennis player, like a skier, often carries large ensembles of equipment to the playing field and convenient techniques for collecting this equipment into one manipulative package are now desired.

Typically a tennis racquet entails a planar structure comprising the handle and the racquet frame in most instances in the prior art was contained in various cloth carrying cases or clamping frames. As new materials were developed for the racquet frame, frame clamps are no longer necessary and the most prevalent manner of transporting racquets is by way of cloth containers. Normally such cloth containers include zippered pockets into which the various other items of the game are stored. The cost of manufacturing such a zippered containers has become prohibitive and devices which are more conveniently produced are desired in the marketplace.

SUMMARY OF THE INVENTION

Accordingly it is the general purpose and object of the present invention to provide a carrier assembly adapted to secure a plurality of racquets in one integral unit, such carrier assembly further including provisions for the storage of tennis balls.

Further objects of the invention are to provide a carrier assembly which is conveniently arranged for ease of manufacture and which by virtue of its pivotal engagement secures tennis balls by clamping.

Yet further objects of the invention are to provide a tennis racquet carrier formed as a clamp and arranged for securing a plurality of racquets.

Yet additional objects of the invention are to provide a tennis carrier which is easy to produce requires few parts and is convenient in manufacture.

Briefly these and other objects are accomplished within the present invention by providing a hollow rectangularly shaped support base including dorsal surface connected to a planar handle extending vertically therefrom. The support base includes pivotal connections at the lateral edges of the ventral surface thereof each engaging a pivoted side plate provided with spring clips. A rectangular cavity, the two hinged side plates providing the remainder of the enclosing structure when engaged to the handle. Each side plate extends beyond the dorsal surface of the base to form a set of opposing surfaces between which tennis racquets may be clamped. To insure a clamping engagement the opposing surfaces of the handle structure and the side plates are lined with a layer of flexible foam, the dimensions of the spring clips loading the racquet in compression when engaged. The base structure itself is conformed to store a plurality of tennis balls thus collecting the necessary items of the game in one integral assembly.

DESCRIPTION OF THE SPECIFIC EMBODIMENT

Figure 1:
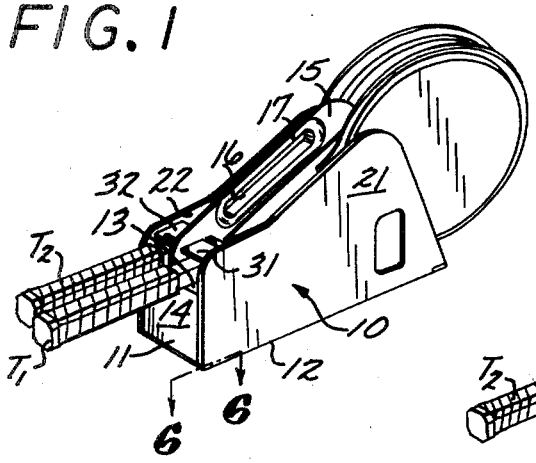
FIG. 1 is a perspective illustration of a racquet carrier constructed according to the present invention.

As shown in FIGS. 1 through 4 the inventive racquet carrier generally designated by the numeral 10 comprises a substantially rectangular base 11 enclosed by a ventral support surface 12 on the underside and a dorsal surface 13 on the upper side. The rear edge of base 11 is closed by an end surface 14 while the forward end is closed by convolving the dorsal surface 13 along a taper towards the ventral surface. Extending vertically from surface 13, in the manner of a spine, is a handle plate 15 of a substantially triangular planform, plate 15 including a handle recess 16 proximate one free edge thereof surrounded by an enlarged bead 17 for grasping comfort.

In this form the handle plate 15 provides the larger lateral surfaces proximate the tapered juncture of surfaces 12 and 13. This enlargement of lateral surface accommodates the varying plan dimensions of two tennis racquets $T_1$ and $T_2$ disposed on either side of the handle plate 15. In this position racquets $T_1$ and $T_2$ are retained by two pivoted side plates 21 and 22 hinged from the lateral edges of the ventral surface 12, each side plate extending beyond the edges of the dorsal surface 13 to a planform substantially conforming with the handle plate 15. Thus side plates 21 and 22 provide opposing surface segments above surface 13 along either side of handle plate 15. Attached to the sides of plate 15 and to the opposing segments of side plates 21 and 22 are sheets of flexible foam **21*a*, 22*a* and 15*a* and 15*b*. Similarly the exterior of surface 13 is covered by strips of flexible foam 13*a* and 13*b*. It is within these foam lined cavities that racquets $T_1$ and $T_2$ are retained. Furthermore within the confines of surfaces 12 and 13 the side plates complete the enclosure of base structure 11**, the interior cavity thus formed being dimensioned to receive a can of tennis balls C.

Figure 2:
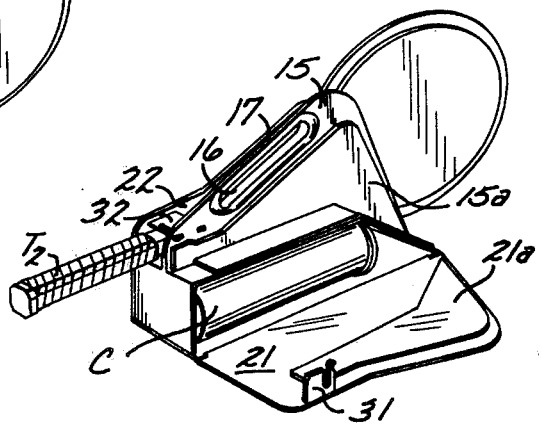
FIG. 2 is a perspective view of the carrier shown in FIG. 1 in an unfolded state.
Figure 3:
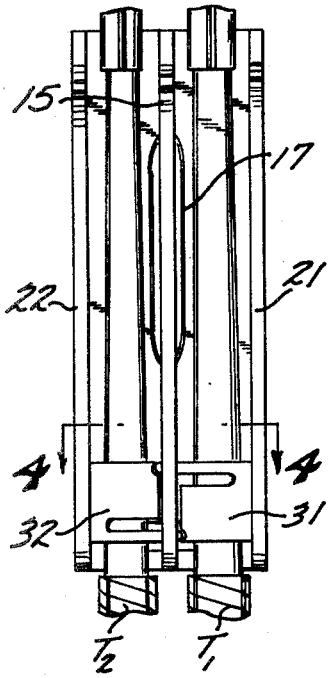
FIG. 3 is a top view of the carrier shown in FIG. 1, illustrating the closure alignment thereof.
Figure 4:
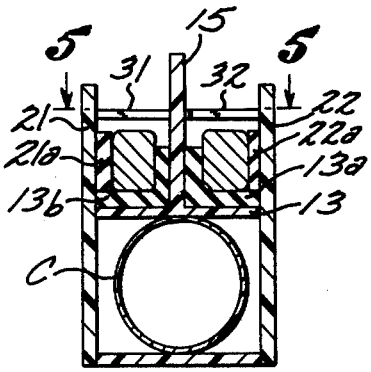
FIG. 4 is an end view, in section, of the carrier taken along line 4—4 of FIG. 3.
Figure 5:
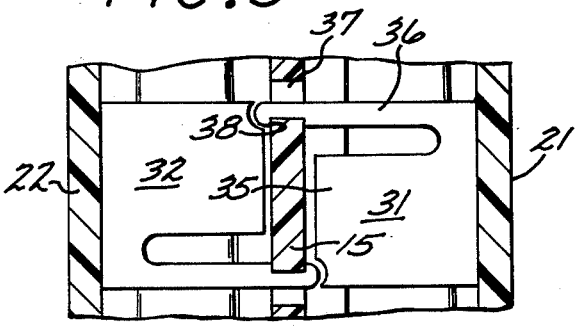
FIG. 5 is a detail view taken along lines 5—5 of FIG. 4.

As shown in FIGS. 2, 3 and 5 each side plate 21 and 22 includes a corresponding latching projection 31 and 32 respectively directed towards the handle plate 15. By way of common illustration projection 31 comprises an orthogonal planar structure including a stop plate 35 formed adjacent a latching finger 36. Finger 36 extends beyond the free edge of the stop plate 35 to be received in an opening 37 formed in the handle plate 15. The alignment of finger 36 is biased towards one edge of opening 37 for engagement therewith by way of a lateral notch 38. In this manner further inward articulation of side plate 21 is limited by the contact of the free edge of stop plate 35 against the surface of handle plate 15. Outward articulation is achieved by manual release of the engaging alignment of finger 36 within opening 37. Projection 32 is similarly formed including a finger 46 deployed adjacent a stop plate 45 and engaged in an opening 47 in the handle.

Figure 6:
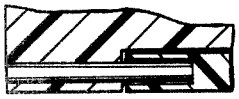
FIG. 6 is yet another detail view taken along line 6—6 of FIG. 1 illustrating the hinge implementation useful with the invention herein.

The foregoing side plate assemblies are pivoted from the lateral edges of ventral surface 12 by way of the hinge shown in FIG. 6. More specifically surface 12 includes two lateral recesses along the edges thereof, a recess 51 being illustrated. Extending from the longitudinal edges of surface 12 into the recess 51 are pivot pins 52 which in turn engage the corresponding side plates illustrated by reference to side plate 21. The foregoing apparatus may be made of plastic material structure thus allowing for convenience in manufacturing and assembly.

It should be understood that the present structure may be utilized for other athletic instruments, the adaptation being mainly in the dimensions. In each instance projections 31 and 32 are deployed above the recess receiving the instrument handle thus being conveniently accessible for release while concurrently surrounding the handle.

Obviously many modifications and variations to the above disclosure can be made without departing from the spirit of the invention. It is therefore intended that the scope of the invention be determined solely on the claims appended hereto.

What is claimed is:

1. A carrying structure adapted to store a plurality of racquets or other athletic devices together with the balls useful therewith, comprising:

a hollow base structure conformed as a rectangular cavity including a dorsal peripheral segment and a ventral peripheral segment joined in common at the ends thereof and separated relative each other to receive a plurality of said balls therebetween;

a planar handle assembly attached to the exterior surface of said dorsal segment to project orthogonally therefrom;

a first and second side plate hinged from the respective lateral edges of said ventral segment and disposed for pivotal motion to abut the lateral edges of said dorsal segment for alignment adjacent said planar handle assembly, said side plates and said handle assembly projecting beyond said dorsal segment to form opposing surfaces of a planform substantially smaller than said racquets;

a deformeable liner attached to the lateral surfaces of said handle assembly and to the opposing surfaces of said first and second side plate; and engaging means extending proximate the free edges of said side plates and deployed to engage said handle assembly said engaging means releasably securing said side plates to said handle assembly at a separation whereby said liner is deformably engaged against said racquets inserted therebetween.

2. Apparatus according to claim 1 wherein:

said handle assembly includes a handle opening proximate the free edge thereof.

3. Apparatus according to claim 2 wherein:

said engaging means each comprise planar structures extending orthogonally from said corresponding side plates to abut the opposing surfaces of said handle assembly and associated latching fingers extending adjacent said structures; and said handle assembly includes latching ports adapted to receive said latching fingers.

4. Apparatus according to claim 3 wherein:

each said latching finger includes a lateral latching cutout aligned to engage a corresponding edge of said latching port.

5. Apparatus according to claim 4 wherein:

said liner is made from compressible foam material; and said latching fingers are flexible for release thereof by manual articulation.

* * * * *